US005457971A

United States Patent [19]

Yamada

[11] Patent Number: 5,457,971

[45] Date of Patent: Oct. 17, 1995

[54] DOOR LOCKING HANDLE ASSEMBLY OF PULL-OUT AND SIDE-SWINGING LEVER-ACTION TYPE

[75] Inventor: Kenichi Yamada, Tokyo, Japan

[73] Assignee: Takigen Manufacturing Co., Ltd., Tokyo, Japan

[21] Appl. No.: 197,060

[22] Filed: Feb. 16, 1994

[30] Foreign Application Priority Data

Mar. 11, 1993 [JP] Japan ..... 5-077627

[51] Int. Cl.[6] ..... E05B 13/10

[52] U.S. Cl. ..... 70/208; 70/210; 70/215; 70/224; 292/202; 292/DIG. 31; 292/DIG. 37

[58] Field of Search ..... 70/208, 210, 215, 70/224, 467, 469, 489, 201, 205, 192–197, 462, 466, DIG. 31, DIG. 33; 292/DIG. 37, 202, DIG. 31, 244, DIG. 72, 336.3

[56] References Cited

U.S. PATENT DOCUMENTS

| | | | |
|---|---|---|---|
| 2,156,513 | 5/1939 | Roedding | 70/210 |
| 2,573,061 | 10/1951 | Raymond | 292/DIG. 37 X |
| 2,648,561 | 8/1953 | Landon | 292/DIG. 37 X |
| 3,250,558 | 5/1966 | McClintock | 292/DIG. 31 X |
| 4,134,281 | 1/1979 | Pelcin | 70/208 |
| 4,510,779 | 4/1985 | Ahad | 70/208 |
| 4,638,649 | 1/1987 | Chao | 70/208 X |
| 4,689,976 | 9/1987 | Larsen | 70/208 |

FOREIGN PATENT DOCUMENTS

| | | | |
|---|---|---|---|
| 729425 | 12/1942 | Germany | 70/208 |
| 198764 | 12/1988 | Japan . | |
| 66369 | 6/1991 | Japan . | |
| 596473 | 1/1948 | United Kingdom | 70/208 |
| 599440 | 3/1948 | United Kingdom | 70/208 |

*Primary Examiner*—Lloyd A. Gall
*Attorney, Agent, or Firm*—Martin Smolowitz

[57] ABSTRACT

A door locking handle assembly of a pull-out and side-swinging lever-action type, in which the entire length of a casing (1) is minimized while an effective length of a handle (18) is sufficiently obtained to improve the assembly in operability. A catch plate (50) is fixed to a locking shaft (11) mounted in a cylindrical portion (2) of the casing (1). The handle (18) is received in a front concave portion (3) of the casing (1) and is pivoted to the shaft (11) through a cross pivot (40). A latch element (25) engaged with and disengaged from a hook (19) of the handle (18) is received in a latch casing (29). The element (25) is interlocked with a push button (37) in a depressing operation thereof to linearly move so that the handle (18) locked up in the casing (1) is released to project from the casing (1) by a biasing spring (41). A lock plate (48) is interlocked with a rotor (45) of a lock unit (44) fixed to the handle (18) so that the lock plate (48) is engaged with and disengaged from a hook (30) of the latch casing (29).

5 Claims, 6 Drawing Sheets

DOOR LOCKING HANDLE ASSEMBLY OF PULL-OUT AND SIDE-SWINGING LEVER-ACTION TYPE

BACKGROUND OF THE INVENTION

1. Field of the Invention

The present invention relates to a door locking handle assembly of a pull-out and side-swinging lever-action type. The door locking handle assembly is used in a plugboard box and the like. In operation, the retractable handle of the assembly is pulled out of its casing and side-swung through a predetermined angle to permit a catch plate of the assembly to be free from a receiving portion of a stationary frame element.

2. Description of the Prior Art

In a conventional door locking handle assembly of a pull-out and side-swinging lever-action type disclosed in Japanese Utility Model Laid-Open No. Sho 63-198764: a cylinder portion is provided in a base-end portion of a casing fixedly mounted on a door; a locking shaft is rotatably mounted in the cylindrical portion in an insertion manner; a catch plate is fixedly mounted on a rear-end portion of the locking shaft; a retractable handle folds into a front concave portion of the casing, and has its base-end portion pivoted to a front-end portion of the locking shaft through a cross pivot; a biasing spring for swingably biasing the retractable handle in its projecting direction on the cross pivot, the biasing spring being mounted between the locking shaft and the handle; a locking aperture is provided in a finger-engaging projecting portion of a front-end portion's rear surface of the handle; a lock unit is fixedly embedded in a lock-receiving portion provided in a front-end portion of the casing; and, a latch element is so arranged as to be interlocked with a rotor of the lock unit, and is biased forward towards the finger-engaging projecting portion by a return spring to have a front-end portion of the latch element engaged with the locking aperture so that the handle is locked up in its retracted position.

However, in the conventional door locking handle assembly described above, there is a fear that the front-end portion of the handle hits a user's fingers. Namely, when the user inserts a key into the lock unit to have its rotor rotated in an unlocking direction thereof, the latch element slidably moves backward to be free from the locking aperture of the handle, so that the handle is projected forward and turned under the influence of a resilience force exerted by a biasing spring, whereby the front-end portion of the handle hits the user's fingers.

In order to prevent the handle from hitting the user's fingers, it is sufficient to dispose the lock unit in a position far away from the front-end portion of the handle. However, naturally, this causes the entire length of the casing to increase. In order to set a sufficient interval between the lock unit and the handle without increasing the entire length of the casing, it is sufficient to decrease the handle in length. However, when a grip portion of the handle is extremely shortened, the handle is impaired in operability. Consequently, such shortening of the grip portion of the handle is not adequate.

SUMMARY OF THE INVENTION

It is an object, of the present invention to provide a door locking flush handle assembly of a pull-out and side-swinging lever-action type, in which assembly a grip portion of a handle has a sufficient effective length while the entire length of a casing is minimized with improved operability.

The above objects of the present invention are accomplished by providing:

a door locking handle assembly of a pull-out and side-swinging lever-action type, comprising:

a casing for fixedly mounting on a door;

a locking shaft rotatably mounted in a cylindrical portion of a base-end portion of the casing in an insertion manner, the locking shaft being non-axially slidable in the cylindrical portion and having its rear-end portion fixed to a catch plate;

a retractable handle which folds into a front concave portion of the casing, and has its base-end portion pivoted to a front-end portion of the locking shaft through a first cross pivot;

a biasing spring for swingably biasing the retractable handle in its projecting direction on the first cross pivot, the biasing spring being mounted between the locking shaft and the handle;

a latch casing fixedly mounted in a front-end portion of the front concave portion of the casing, the latch casing being provided with an engaging-hook portion in its base-end portion;

a button casing fixedly mounted on an upper surface of the latch casing;

a push button mounted in a space in a central portion of the button casing so as to be slidable in a direction perpendicular to a longitudinal direction of the button casing, the push button being provided with an oblique surface in its bottom surface;

a first return spring mounted in a bottom surface of the push button for urging the push button outward;

a latch element which is provided with an oblique surface in its upper surface, has the oblique surface abut against the corresponding oblique surface of the bottom surface of the push button, is interlocked with the push button during a depressing operation of the push button, and, therefore slidably moves in a space between the push button and the latch casing in its longitudinal direction to engage with and disengage from the engaging-hook portion of the front-end portion of the handle;

a second return spring for urging the latch element toward the handle;

a lock unit fixedly embedded in a lock-receiving portion of the front-end portion of the handle; and a lock plate which is interlocked with a rotor of the lock unit so as to move back and forth as the rotor rotates, so that the lock plate is engaged with and disengaged from the engaging-hook portion of the base-end portion of the latch casing.

DESCRIPTION OF THE PREFERRED EMBODIMENTS

Figure 1:
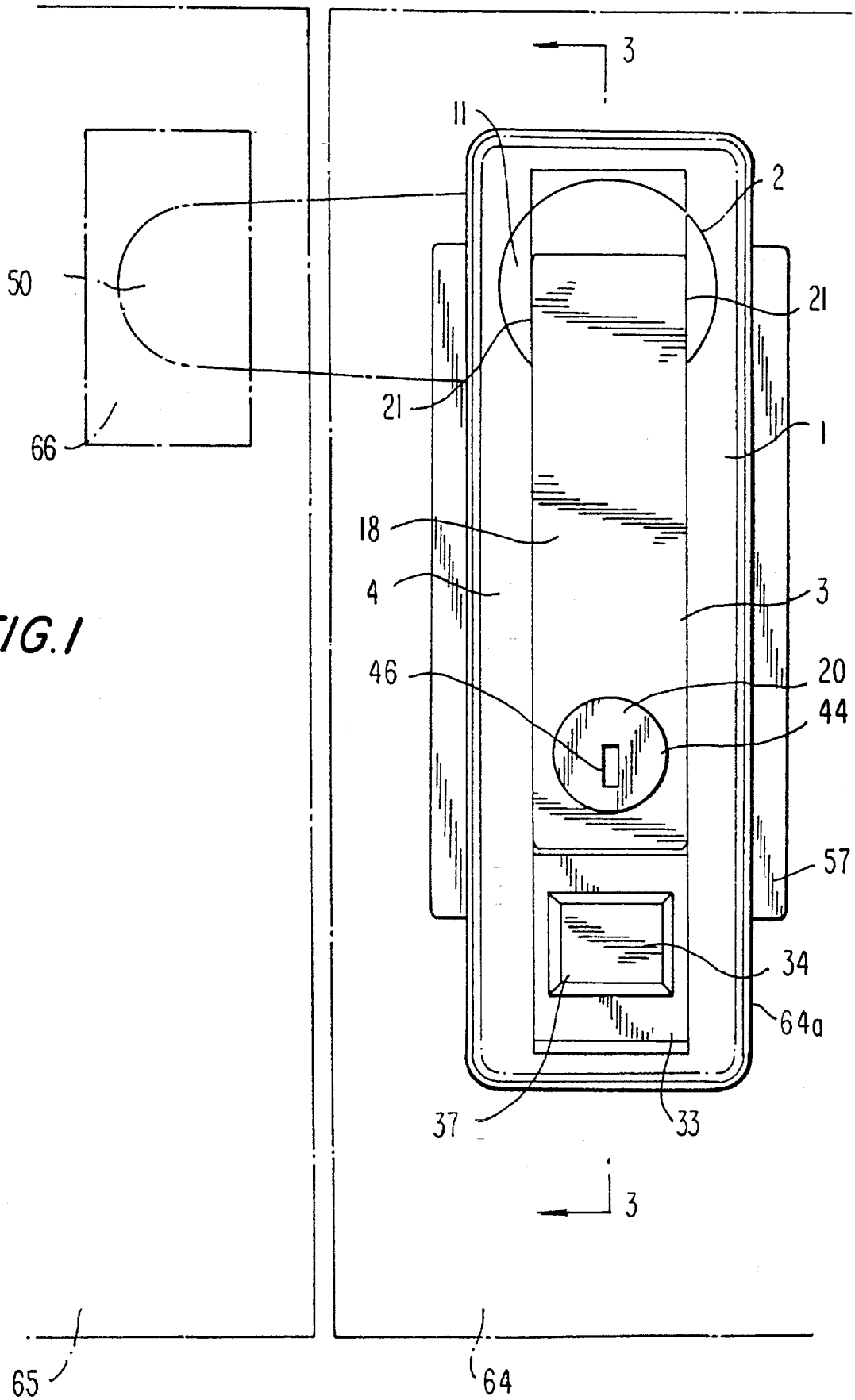
FIG. 1 is a front view of an embodiment of the door locking handle assembly of a pull-out and side-swinging lever-action type of the present invention.
Figure 2:
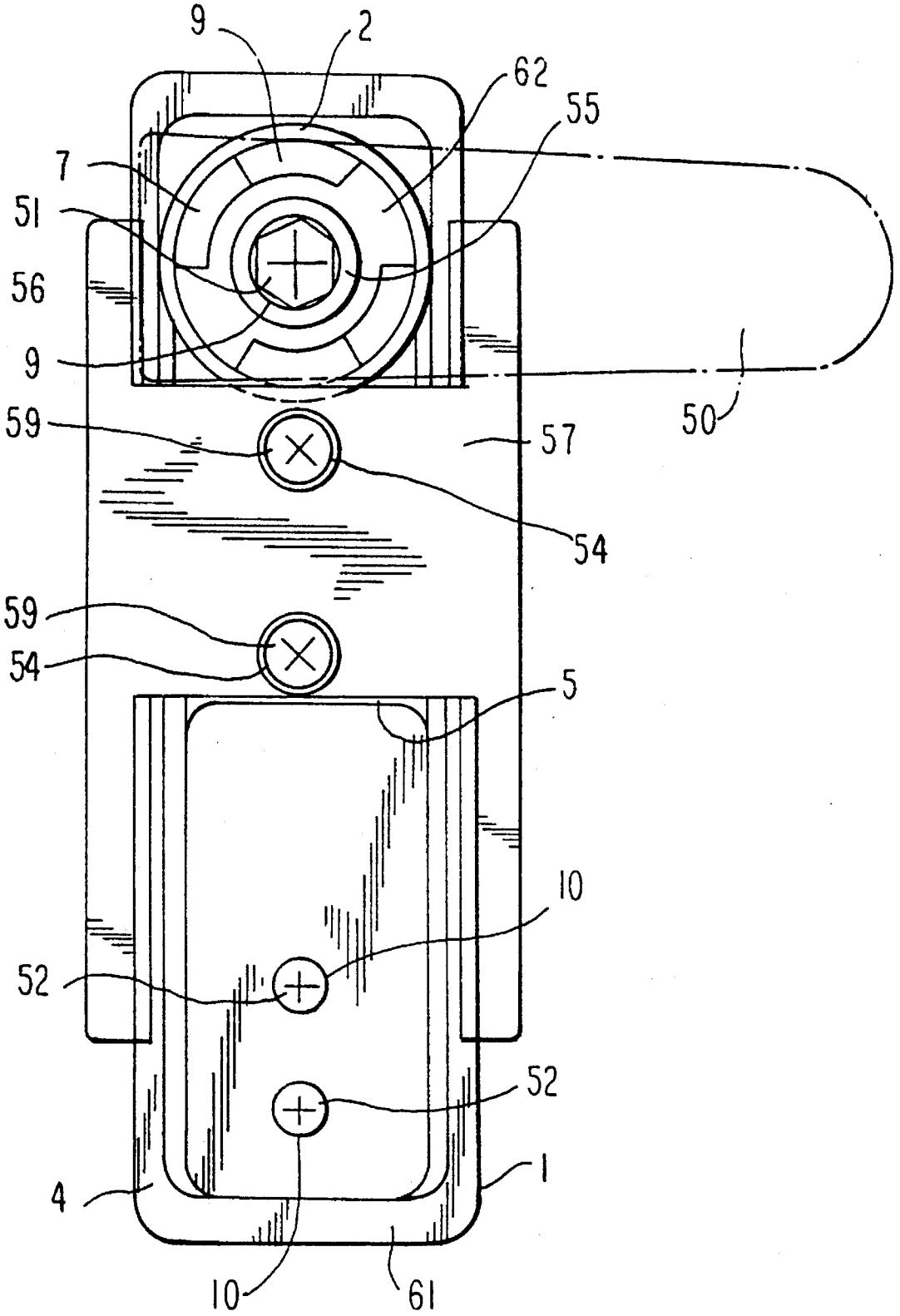
FIG. 2 is a rear view of the door locking assembly of tile present invention shown in FIG. 1.

Hereinbelow, the present invention will be described in detail with reference to the accompanying drawings and the reference numerals and characters.

In a door locking handle assembly of a pull-out and side-swinging type according to the present invention, as shown in FIG. 1, a casing 1 is fixedly mounted on a door 64, and provided with a cylindrical portion 2 in its base-end portion. Rotatably mounted in the cylindrical portion 2 is a locking shaft 11 to a rear-end portion of which a catch plate 50 is fixedly mounted.

A retractable handle 18 folds into a front concave portion 3 of the casing 1 so as to be projectable therefrom. The handle 18 has its base-end portion 21 pivoted to a front-end portion of the locking shaft 11 through a first, cross pivot 40. A biasing spring 41 is disposed between tile locking shaft 11 and the handle 18, and forces the handle 18 to swing on the first cross pivot 40 in a projecting direction of the handle 18.

A latch casing 29 is fixedly mounted in a front concave portion 3 of the casing 1. A button casing 33 is fixedly mounted on an upper surface 29*a* of the latch casing 29. A push button 37 is mounted in a space 34 in a central portion of the button casing 33 so as to be slidable in a direction perpendicular to a longitudinal direction of the button casing 33. The push button 37 is provided with an oblique surface 38 in its bottom surface. A first, return spring 43 is mounted on a bottom surface 37*a* of the push button 37 for urging the push button 37 outward. A latch element 25, which is provided with an oblique surface 26 in its upper surface 25*a*, has the oblique surface 26 abut against the corresponding oblique surface 38 of the bottom surface of the push button 37 and, is interlocked with the push button 37 during a depressing operation of the push button 37. Therefore the latch element 25 slidably moves in a space 49 between the push button 37 and the latch casing 29 in its longitudinal direction to engage with and disengage from the engaging-hook portion 19 of the front-end portion the handle 18. A second return spring 42 for urging the latch element 25 toward the handle 18 is mounted on the latch element 25.

Another engaging-hook portion 30 is provided in a base-end portion of the latch casing 29. In operation, the oblique surface 38 in the bottom surface of the push button 37 abuts against the corresponding oblique surface 26 in the upper surface 25*a* of the latch element 25, so that the latch element 25 is slidably moved in its longitudinal direction when the push button 37 is depressed, whereby the latch element 25 is engaged with and disengaged from the engaging-hook portion 19 of the front-end portion of the handle 18.

A lock unit 44 is fixedly embedded in a lock-receiving portion 20 of the front-end portion of the handle 18. A lock plate 48 is interlocked with a rotor 45 of the lock unit 44 so as to move back and forth as the rotor 45 rotates, so that the lock plate 48 is engaged with and disengaged from the engaging-hook portion 30 of the front-end portion of the latch casing 29.

Figure 3:
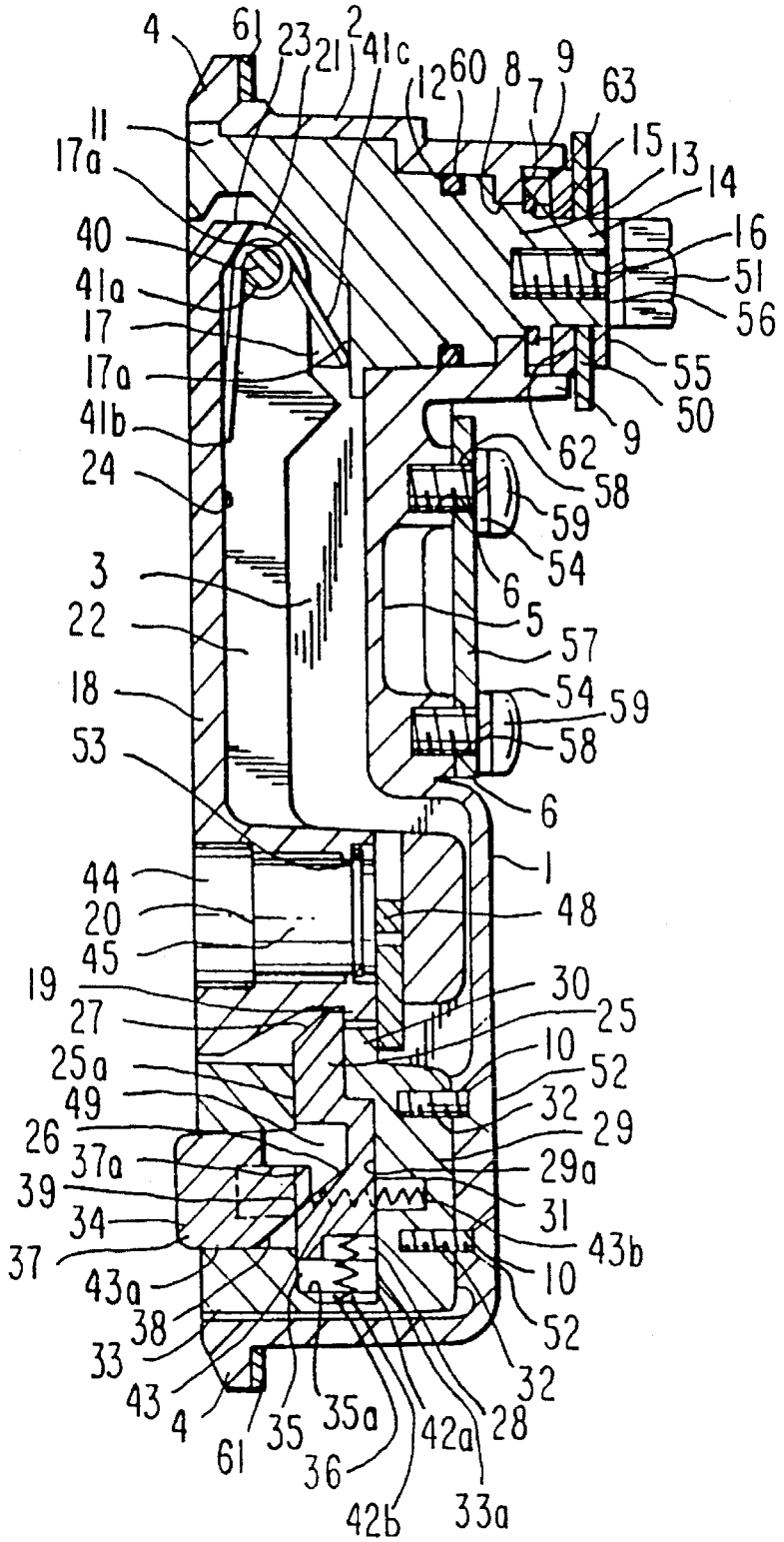
FIG. 3 is a sectional view of the door locking assembly of the present invention, taken along the line 3—3 of FIG. 1.
Figure 4:
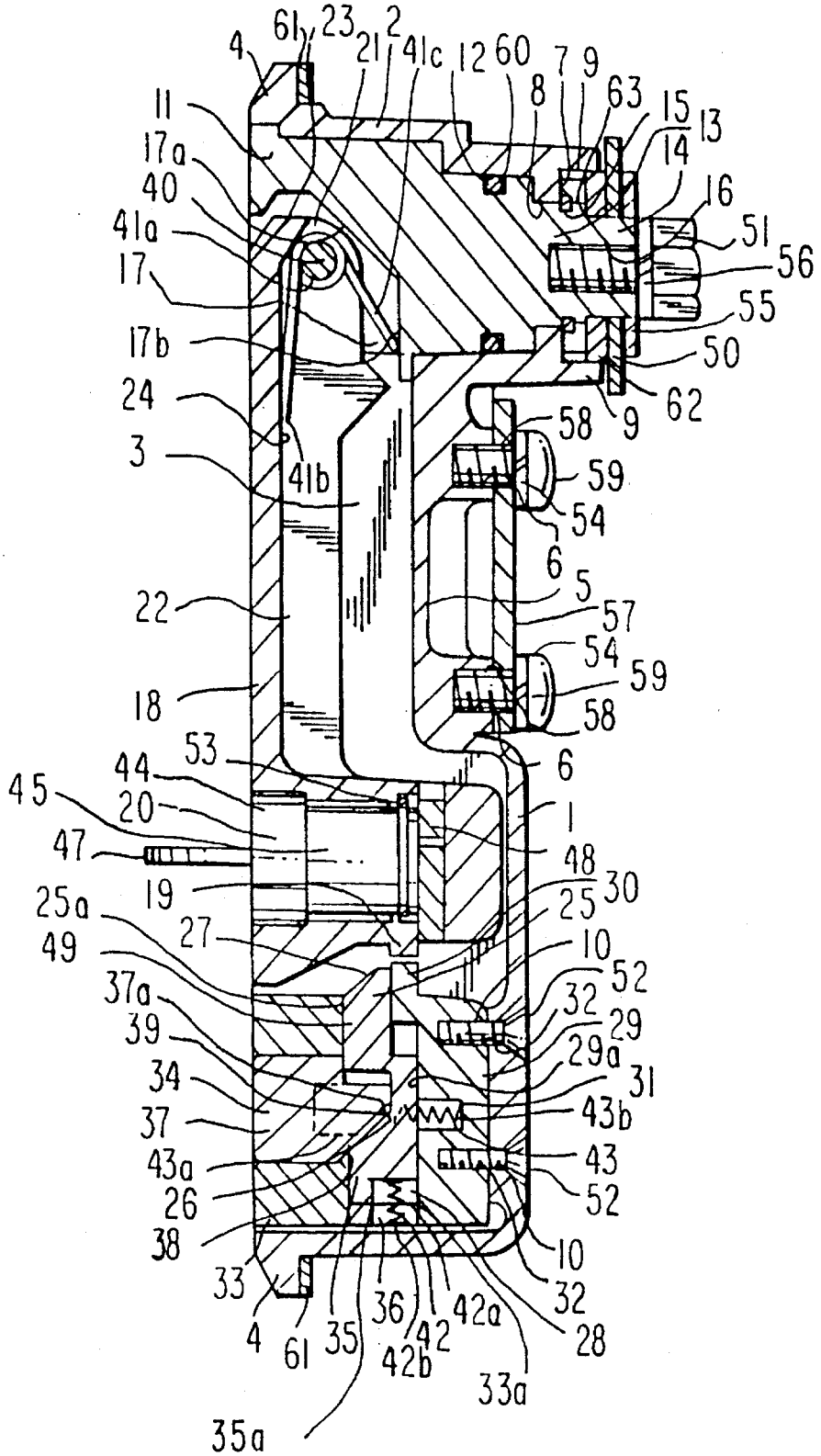
FIG. 4 is a sectional view of the door locking assembly of the present invention shown in FIG. 1 in a condition in which tile push button is depressed.

As shown in FIG. 3, the catch plate 50 having been-fixed to the rear-end portion of the locking shaft 11 engages with a receiving portion 66 of a stationary frame element 65. In case that the handle 18 is in its retracted position in the front concave portion 3 of the casing 1, the latch element 25 reaches its most advanced position so that the engaging-hook portion 19 of the front-end of the handle 18 is engaged with the front-end of the latch element 25, whereby the handle 18 is held in its retracted position. At this time, the lock plate 48 is also engaged with the engaging-hook portion 30 of the latch casing 29 so that the handle 18 is locked up in its retracted position, whereby the door 64 is locked up relative to the stationary frame element 65 without fail.

Figure 5:
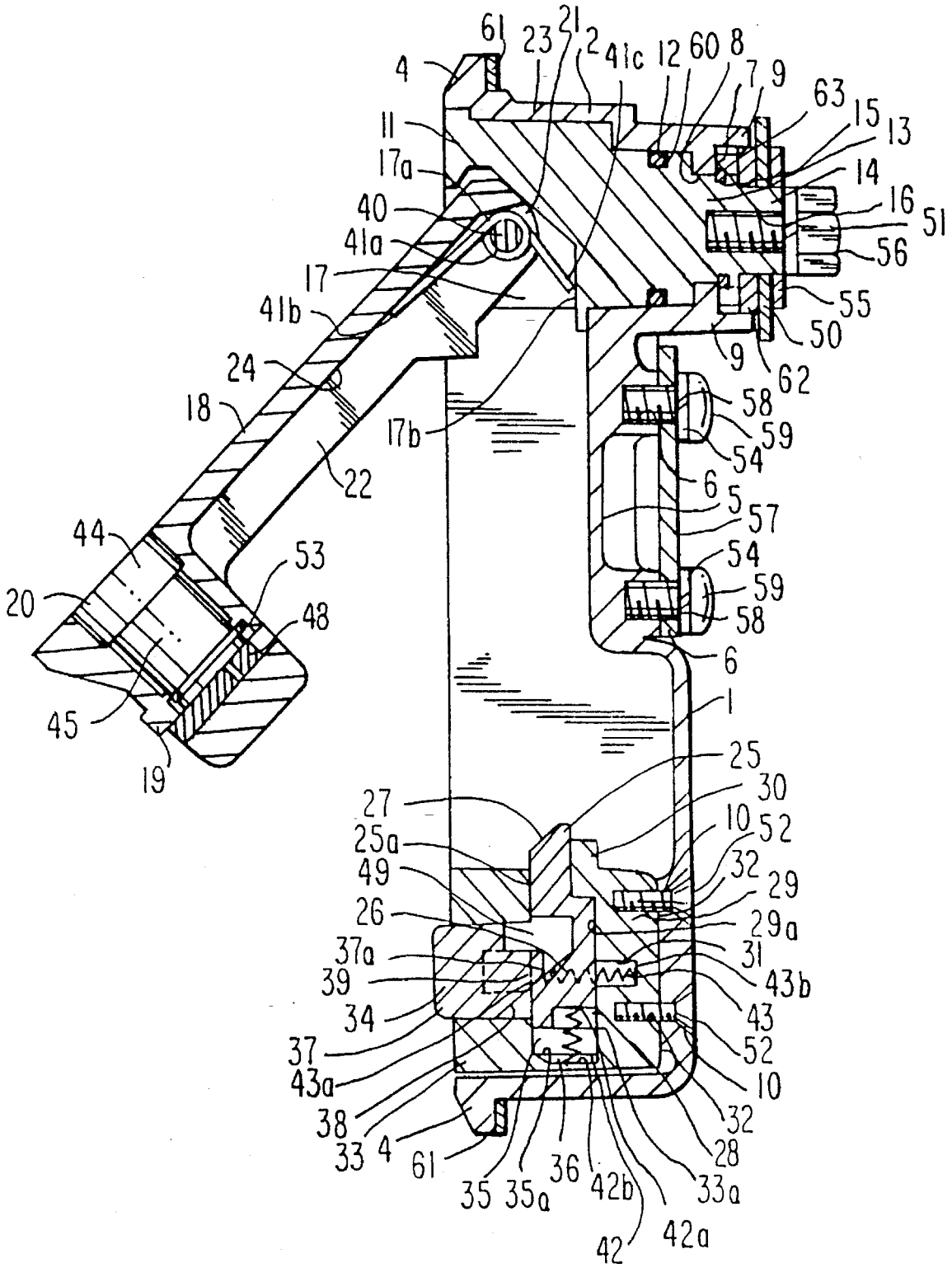
FIG. 5 is a sectional view similar to FIG. 4, in which the handle is swingably projected.

In case that the handle 18 is to be projected, as shown in FIG. 5, a key 47 is inserted in a keyhole 46 of the lock unit 44 to rotate the rotor 45 so that the lock plate 48 is moved back, whereby the engaging-hook portion 30 of the latch casing 20 is disengaged from the lock plate 48. At this time, since the engaging-hook portion 19 of the front-end portion of the handle 18 is still engaged with the front-end portion of the latch element 25, the handle 18 is also still held in its retracted position. When the user depresses the push button 37, the oblique surface 38 of the push button 37 abuts against the corresponding oblique surface 26 of the latch element 25, so that the latch element 25 is slidably moved back against the resilient force exerted by the second return spring 42, whereby the engaging-hook portion 19 of the front-end portion of the handle 18 is disengaged from the latch element 25. As a result, the handle 18 is immediately projected from the front concave portion 3 of the casing 1 under the influence of the resilient force exerted by the biasing spring 41.

As shown in FIG. 5, when the handle 18 is projected and the push button 37 is released from the depressing effort of the user, the push button 37 slidably moves outward under the influence of the resilient force exerted by the first return spring 43 to reach its initial position. At the same time, the latch element 25 is also slidably returned to its most advanced position under the influence of the resilient force exerted by the second return spring 42.

When the user swings the thus projected handle 18 sideward in a predetermined direction, the locking shaft 11 having been pivoted to the handle 18 through the first cross pivot 40 rotates or swings in the cylindrical portion 2 of the casing 1 together with the handle 18 so that the catch plate 50 is disengaged from the receiving portion 66 of the stationary frame element 65, whereby the door 64 is unlocked relative to the stationary frame element 65. As a result, the user may open the thus unlocked door 64 by pulling it forward. In this opening operation of the door 64, the lock-receiving portion 20 of the front-end portion of the handle 18 also serves as a suitable finger-engaging portion.

Figure 6:
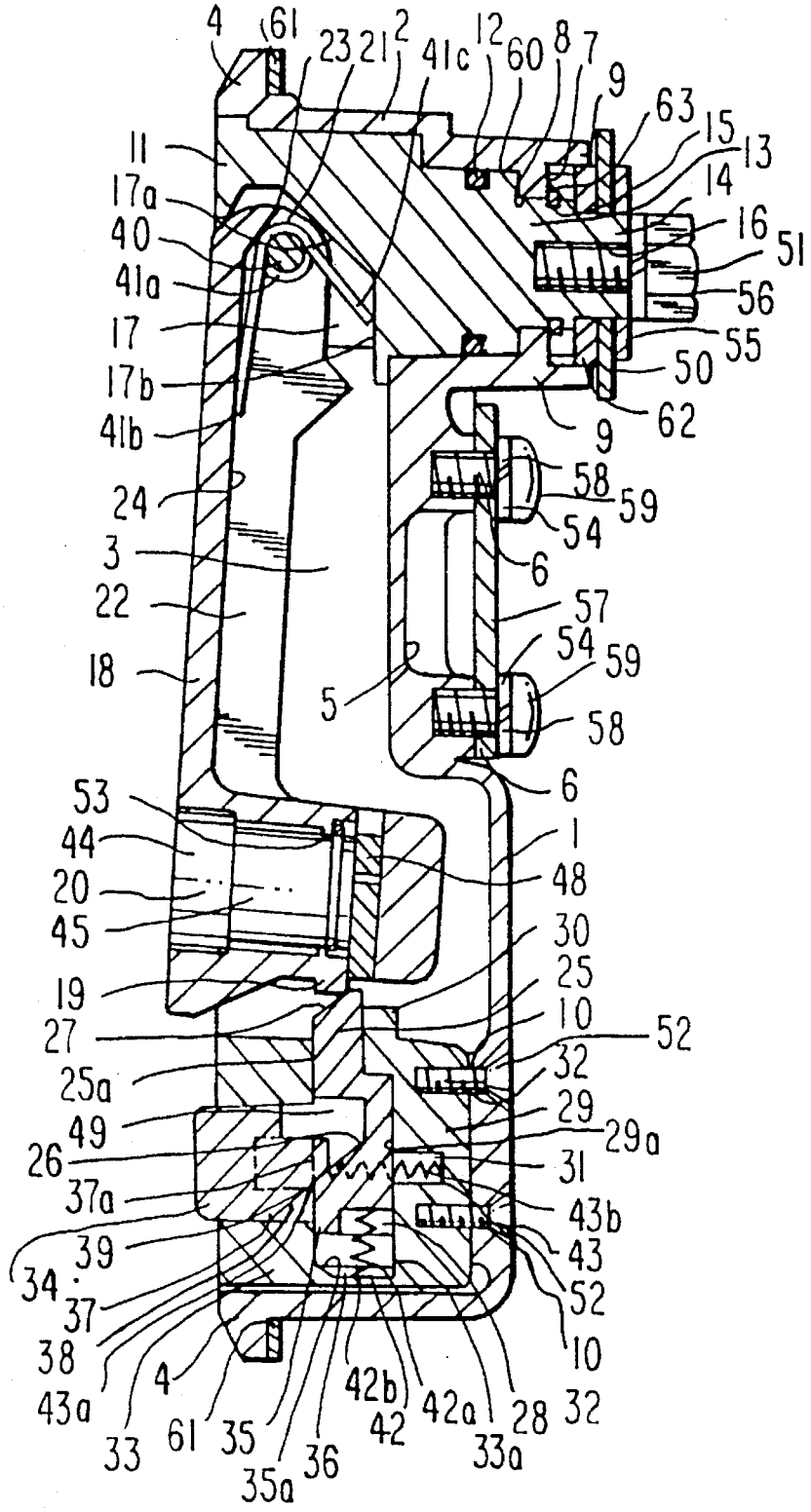
FIG. 6 is a sectional view similar to FIG. 4, in which the handle is swingably retracted.

After the door 64 is closed and the handle 18 is swung back to have the catch plate 50 engaged again with the receiving portion 66 of the stationary frame element 65, the handle 18 is pushed into the front concave portion 3 of the casing 1. As this time, as shown in FIG. 6, the engaging-hook portion 19 of the front-end portion of the handle 18 pushes against the oblique surface 27 of the front-end of the latch element 25. As a result, the latch element 25 is temporarily moved back against the resilient force exerted by the second return spring 42. When the handle 18 is further pushed in so that the engaging-hook portion 19 of the front-end portion of the handle 18 clears the oblique surface 27 of the front-end of the latch element 25 while guided by this oblique surface 27, the latch element 25 is immediately slidably moved upward under the influence of the resilient force exerted by the second return spring 42 to have the engaging-hook portion 19 of the handle 18 engaged with the front-end of the latch element 25. As a result, the handle 18 is held in its retracted position in the casing 1. Under such circumstances, the key 47 is inserted in the keyhole 46 to rotate the rotor 45 so that the lock plate 48 is moved downward to have its lower-end portion engaged with the engaging-hook portion 30 of the latch casing 29. As a result, as shown in FIG. 1, the handle 18 is locked up in its retracted position without fail so that the door 64 is locked up relative to the stationary frame element 65.

In the embodiment of the present invention shown in the drawings, the casing 1 is fixedly mounted in the door 1 as follows. Namely, first, the casing 1 is inserted into a longitudinal opening portion 64*a* of the door 64 from its front side, and has its outer peripheral flange portion 4 abutted against a front surface of the door 64. Then, a U-shaped sheet metal bracket 57, which covers an intermediate portion of the casing 1 in its rear side, is abutted against a rear surface of the door 64, and fixedly mounted on the door 64 through tapping screws 59 each of which passes through a through-hole 58 of the sheet metal bracket 57 and is threadably connected with a blind hole 6 formed in a rear wall 5 of the above intermediate portion of the casing 1. A packing 61 is interposed between a front surface of the door 64 and the casing 1.

A watertight O-ring seal 60 is fitted in an annular groove 12 of the intermediate portion of the locking shaft 11 which has its small-diameter portion 13 fitted in an axial hole 8 of a rear-surface wall portion 7 of the cylindrical portion 2 of the casing 1. The small-diameter portion 13 of the locking shaft 11 is followed by a square-column portion 14 on which both a swing-angle limiting plate 62 and the catch plate 50 and spacer plate 55 are mounted in an insertion manner, and then a bolt 51 is threadably connected with a threaded hole 16 of the square-column portion 14 to have these plates 62, 50 fixed to the square-column portion 14, so that the locking shaft 11 is rotatably mounted in the cylindrical portion 2 of the casing 1 but not axially slidable therein. The rear-surface wall portion 7 of the cylindrical portion 2 of the casing 1 is provided with a swing-angle limiting projection 9 which abuts against the swing-angle limiting plate 62 to cooperate therewith to limit the handle 18 in swinging angle.

Formed in a front-end portion of the locking shaft 11 is a recess 17. Pivoted to the recess 17 through the first cross pivot 40 is the base-end portion 21 of the handle 18, which portion 21 is formed into a semicircular shape as viewed in FIGS. 3 to 6, so that the handle 18 is obliquely projected from the casing 1 and is swung or rotate together with the locking shaft 11 while supported by the cylindrical portion 2 of the casing 1. A pair of ribs 22 are provided in opposite side surfaces of the handle 18. A flat-surface portion 23 of the base-end portion of the handle 18 abuts against an oblique surface 17*a* of the recess 17 of the locking shaft 11 to determine a projecting angle of the handle 18 relative to the casing 1. The biasing spring 41 is constructed of a coil spring 41. The spring 41 has its coiled portion 41*a* mounted on the first cross pivot 40 in an insertion manner, and its linear portion 41*c* abut against the bottom surface 17*b* of the recess 17 of the locking shaft 11. In addition, the biasing spring 41 has its remaining linear portion 41*b* abut against the rear surface 24 of the handle 18.

Four corner portions of the upper surface portion 29*a* of the latch casing 29 are constructed of thin plate, and provided with through-holes. Threaded holes corresponding to these through-holes are provided in four corners of the bottom surface portion 33*a* of of the button casing 33. Screws pass through the through-holes of the latch casing 29 and then threadably connected with the threaded holes of the button casing 33, so that the button casing 33 is attached to the latch casing 29.

Provided in the bottom surface portion of the button casing 33 is an elongated recess 35 which cooperates with the upper surface 29*a* of the latch casing 29 to define the space 49 in which the latch element 25 is received so as to be vertically slidable therein. The second return spring 42 mounted on the rear surface of the latch element 25 is constructed of a coil spring which has one 42*a* of its linear portions 42*a*, 42*b* engaged with a concave portion 28 of the rear surface portion of the latch element 25, and has the other 42*b* engaged with the rear wall 35*a* of the inner portion of the recess 35.

On the other hand, the button casing 33 is provided with the space 34 in its central portion. The space 34 forms a through-hole horizontally passing through the central portion of the button casing 33. The push button 37 is received in the space 34 so as to be horizontally slidable therein. The first return spring 43 is mounted on the bottom surface 37*a* of the push button 37 in the latch element 25, and is constructed of a coil spring which has one 43*a* of its opposite linear ends 43*a*, 43*b* engaged with the projection 39 of the bottom surface 37*a* of the push button 37, and has the other end 43*b* engaged with the concave portion 31 of the upper surface 29*a* of the latch casing 29.

The latch casing 29 is provided with a pair of the threaded holes 32 in its rear surface side. A sub-assembly constructed of the latch casing 29, the latch element 25, the button casing 33 and the push button 37 is fixedly mounted on the front-end portion of the front concave portion 3 of the casing 1 through the screws 52 passing through the through-holes 10 of the rear wall portion of the casing 1.

In the embodiment of the present invention, a disk-tumbler locking mechanism is used as a lock mechanism for locking the rotor 45 of the lock unit 44 to the main body of the unit 44. However, it is also possible to use any other suitable lock mechanisms such as radial-pin tumbler locking mechanisms, axial-pin tumbler mechanisms and the like.

As described above, in the door locking handle assembly of a pull-out and side-swinging type according to the present invention: the latch casing 29 is fixedly mounted in the front-end portion of the front concave portion 3 of the casing 1; the button casing 33 is fixedly mounted on the upper surface 29*a* of the latch casing 29; the push button 37 is mounted in the space 34 in the central portion of the button casing 33 so as to be slidable in the direction perpendicular to the longitudinal direction of the button casing 33; the push button 37 is provided with the oblique surface 38 in its bottom surface; the first return spring 43 is mounted on the bottom surface 37*a* of the push button 37 for urging the push button 37 outward; the latch element 25, which is provided with the oblique surface 26 in its upper surface 25*a*, has the oblique surface 26 abut against the corresponding oblique surface 38 of the bottom surface of the push button 37, is interlocked with the push button 37 during the depressing operation of the push button 37, and, therefore slidably moves in the space 49 between the push button 37 and the latch casing 29 in its longitudinal direction to engage with and disengage from the engaging-hook portion 19 of the front-end portion of the handle 18; the second return spring 42 for urging the latch element 25 toward the handle 18 is mounted on the latch element 25; another engaging-hook portion ton 30 is provided in the base-end portion of the latch casing 29; the oblique surface 38 in the bottom surface of the push button 37 abuts against the corresponding oblique surface 26 in the upper surface 25*a* of the latch element 25, so that the latch element 25 is slidably moved in its longitudinal direction when the push button 37 is depressed, whereby the latch element 25 is engaged with and disengaged from the engaging-hook portion 19 of the front-end portion of the handle 18; the lock unit 44 is fixedly embedded in the lock-receiving portion 20 of the front-end portion of the handle 18; the lock plate 48 is interlocked with the rotor 45 of the lock unit 44 so as to move back and forth as the rotor 45 rotates, so that the lock plate 48 is engaged with and disengaged from the engaging-hook portion 30 of the front-end portion of the latch casing 29. Consequently, the handle 18 is projected from the casing 1 when the push button 37 is depressed by the user's finger after the lock unit 44 is operated so that the latch element 25 is disengaged from the engaging-hook portion 9 of the handle 18. At this time, the user's finger has been moved out of the front surface portion of the handle 18, and, therefore there is no fear that the user's finger is hit by the front-end portion of the handle 18. Consequently, it is possible to minimize the clearance between the push button 37 and the handle 18. In addition, it is also possible to effectively use the lock-receiving portion 20 of the handle 18 as the finger-engaging portion, which makes it possible to reduce the handle 18 in length by the length of its lock-receiving portion 20. As a result, according to the present invention, the entire length of the casing 1 is minimized while keeping the sufficient effective length of the grip portion of the handle 18.

Furthermore, according to the mechanism of the present invention as described above, it is possible to smoothly perform the pull-out and push-in operations of the handle 18 relative to the casing 1, which improve the door locking handle assembly of the present invention in operability.

What is claimed is:

1. A door locking handle assembly of a pull-out and side-swinging lever-action type, comprising:

a casing (1) for fixedly mounting on a door (64);

a locking shaft (11) rotatably mounted in a cylindrical portion (2) of a base-end portion of said casing (1) in an insertion manner, said locking shaft (11) being non-axially slidable in said cylindrical portion (2) and having its rear-end portion fixed to a catch plate (50);

a retractable handle (18) which folds into a front concave portion (3) of said casing (1), and has its base-end portion (21) pivoted to a front-end portion of said locking shaft (11) through a first cross pivot (40);

a biasing spring (41) for swingably biasing said handle (18) in its projecting direction on said first cross pivot (40), said biasing spring (41) being mounted between said locking shaft (11) and said handle (18);

a latch casing (29) fixedly mounted on said front concave portion (3) of said casing (1), said latch casing (29) being provided with an engaging-hook portion (30) in its base-end portion;

a button casing (33) fixedly mounted on an upper surface (29*a*) of said latch casing (29);

a push button (37) mounted in a space (34) in a central portion of said button casing (33) so as to be slidable in a direction perpendicular to said button casing (33), said push button (37) being provided with an oblique surface (38) in its bottom surface;

a first return spring (43) mounted on a bottom surface (37*a*) of said push button (37) for urging said push button (37) outward;

a latch element (25) which is provided with an oblique surface (26) in its upper surface (25*a*), has said oblique surface (26) abut against said oblique surface (38) of said bottom surface of said push button (37), is interlocked with said push button (37) during a depressing operation of said push button (37), and therefore slidably moves in a space (49) between said push button (37) and said latch casing (29) in its longitudinal direction to engage with and disengage from an engaging-hook portion (19) of a front-end portion of said handle (18);

a second return spring (42) for urging said latch element (25) toward said handle (18);

a lock unit (44) fixedly embedded in a lock-receiving portion (20) of said front-end portion of said handle (18); and a lock plate (48) which is interlocked with a rotor (45) of said lock unit (44) so as to move back and forth as said rotor (45) rotates, so that said lock plate (48) is engaged with and disengaged from said engaging-hook portion (30) of said base-end portion of said latch casing (29).

2. The door locking handle assembly of claim 1, wherein a seal ring (60) is provided in an annular groove (12) around an intermediate diameter portion of said locking shaft (11).

3. The door locking handle assembly of claim 1, wherein said retractable handle (18) has a flat surface portion (23) located at the handle base-end portion, which flat surface abuts against an oblique surface (17*a*) of a recess (17) for determining the projecting angle of the handle (18) relative to the casing.

4. The door locking handle assembly of claim 1, wherein said casing (1) is inserted into an elongated opening of a door (64) front side so that a peripheral flange (4) of the casing abuts against the door front side, and a mounting plate (57) attached to the casing (1) is abutted against the door rear side and is fixedly mounted on the door.

5. The door locking handle assembly of claim 1, wherein said catch plate (50) is engaged against a receiving portion (66) of a stationary frame element (65).

* * * * *